US006182980B1

(12) United States Patent
Smith

(10) Patent No.: US 6,182,980 B1
(45) **Date of Patent: *Feb. 6, 2001**

(54) IN-LINE ICE SKATES

(76) Inventor: Ronnie Smith, Rte. 1 Box 67, Alum Creek, WV (US) 25003-9503

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/100,873

(22) Filed: Jun. 22, 1998

(51) Int. Cl.[7] ..... A63C 17/18
(52) U.S. Cl. ..... 280/11.231; 280/7.13
(58) Field of Search ..... 280/11.19, 7.13, 280/11.221, 11.231, 11.233, 11.25, 11.24, 7.12, 7.14, 11.12, 841, 8, 7.1

(56) References Cited

U.S. PATENT DOCUMENTS

| | | | | |
|---|---|---|---|---|
| D. 393,037 | * | 3/1998 | Priester | D21/225 |
| 1,489,197 | * | 4/1924 | Daverkosen et al. | 280/11.19 |
| 1,835,446 | * | 12/1931 | Tracey | 280/11.22 |
| 2,377,366 | * | 6/1945 | Paystrup | 180/11.25 |
| 2,559,118 | | 7/1951 | Foran . | |
| 3,689,091 | | 9/1972 | Nagin . | |
| 3,901,520 | | 8/1975 | McMahan . | |
| 4,108,450 | | 8/1978 | Cote . | |
| 4,114,295 | | 9/1978 | Schaefer . | |
| 4,492,385 | * | 1/1985 | Olson | 280/7.13 |
| 5,259,632 | * | 11/1993 | Mahoney | 280/7.14 |
| 5,411,320 | * | 5/1995 | Alderman et al. | 301/5.3 |
| 5,709,395 | | 1/1998 | Lee . | |
| 5,901,970 | * | 5/1999 | Henshaw | 280/11.19 |

* cited by examiner

*Primary Examiner*—Kevin Hurley
*Assistant Examiner*—Andrew J. Fischer
(74) *Attorney, Agent, or Firm*—Robert N. Blackmon

(57) ABSTRACT

An in-line skate having tapered, metallic wheels for skating on ice surfaces. The skate has in-line wheels which are made of metal and taper from an inner main body to an outer edge. The tapered wheels contact the ice and provide a low rolling resistance in a forward direction to facilitate high speed skating and provide in the same surface an edge which has a high friction coefficient when the contact with the ice surface is oblique to the forward direction allowing a skate to push off with the wheels oblique to the line of travel and glide along the line of travel.

3 Claims, 2 Drawing Sheets

IN-LINE ICE SKATES

BACKGROUND OF THE INVENTION

1. Field of the Invention

The present invention relates to an in-line skate for ice skating.

2. Description of the Prior Art

The concept of in line wheels on a skate for rolling across roadways and sidewalks is a old and tried concept. In-line skating has become a popular and profitable industry during the 1990s though the origin goes back many years.

One design of an in-line skate dating back to the 1940s is U.S. Pat. No. 2,559,118 to Foran which shows a pair of in-line wheels which is disclosed to provide a skate capable of great speeds.

The 1975 patent to McMahan, U.S. Pat. No. 3,90,520 shows a more modern version of the two-wheeled, in-line skate.

Others, such as U.S. Pat. No. 5,709,395 to Lee shows complex adaptations of the roller skate to somewhere between an in-line wheeled skate and a double-pair skate by utilizing three wheels per skate.

And of course, numerous designs are available today from companies a wide range of companies providing polyurethane wheels for in-line skating on hard, dry surfaces.

Some skates have been designed to bridge the gap between roller skating and ice skating by providing both blades and wheels, such as U.S. Pat. No. 4,699,390 to Cote for skating on synthetic surfaces. U.S. Pat. No. 3,689,091 to Nagin shows another skate device having wheels and a blade for skating on plastic surfaces.

Adaptable skates which can be converted from ice-skates to roller skates or inline skates have also been attempted. See for instance U.S. Pat. No. 4,114,295 to Schaefer or U.S. Pat. No. 4,10,450 to Cote which show removable blades which can be replaced by roller supports.

However none of these references shows an in-line skate which can be used adequately to skate on ice using only specially designed metal in-line skate wheels. None of the above inventions and patents, taken either singly or in combination, is seen to describe the instant invention as claimed.

The present invention contemplates a new arena of in-line skating which brings the inventive process and improvements to skating full circle. Ice skating has remained somewhat unchanged for decades, relying on the single runner per skate which the skaters uses by gliding along on one foot while pushing off with the runner of the opposite skate by applying the blade to the ice and an angle oblique to the direction of travel. The blade thus applied to the ice instead of sliding is dug into the ice temporarily while the skate pushes off to provide motive force. By alternating the pushing foot and the gliding foot, the skater can propel himself along the rink or skating area.

A major disadvantage to this type of skate is the amount of friction which the skate incurs through contact with the ice. The use of waxes and sharpening are effective in reducing the friction, but not in reaching the minimum friction achieved by the present invention. The present invention reduces the contact area between the skate and the ice by providing metallic wheels in place of the urethane wheels of present in-line skates to reduce the overall surface area in contact with the surface. The metallic wheels have the further advantage of being able to roll or slide on the surface, unlike runner blades of normal ice skates. In all ice-borne vehicles whether it be a snowmobile, sled or ice skate, a certain amount of the ice will melt beneath the runner as a compound effect of the friction and pressure caused by the weight acting downwardly on the runner. The melting increases the friction by both digging a trough in the ice among other effects.

A skate according to the present invention in addition to be able to slide across or through a trough like a runner can roll through out of the trough thereby reducing the resistance of the skate to forward motion. The effect of both the decreased surface area and the ability of the wheels to roll across the ice decrease the friction which the skater most overcome and increase the efficiency of the device. The metallic tapering of the wheels provides both a controllable contact area and pressure and provides a surface with sufficient friction to allow the skater to stand on the ice and to propel himself as discussed above by pushing off against the ice. Plastic wheel and known polyurethane wheels, while providing sufficient motive friction on dry land, would be too slippery on ice or even wet surfaces to provide sufficient stability or motive force.

SUMMARY OF THE INVENTION

Accordingly, it is a principal object of the invention to provide an improved skate structure which can roll on ice.

It is another object of the invention to provide an improved in-line skate having metal wheels for gliding across ice and having a significantly reduce friction coefficient.

It is a further object of the invention to provide metallic wheels which can mounted to a standard skate in place of the standard polyurethane wheels to transform an in-line skate into an improved ice skate.

Still another object of the invention is to provide a skate having tapered, metallic wheels which when mounted to an in-line skate wheel support structure transform a dry land skate into a low friction coefficient ice skate.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

Figure 1:
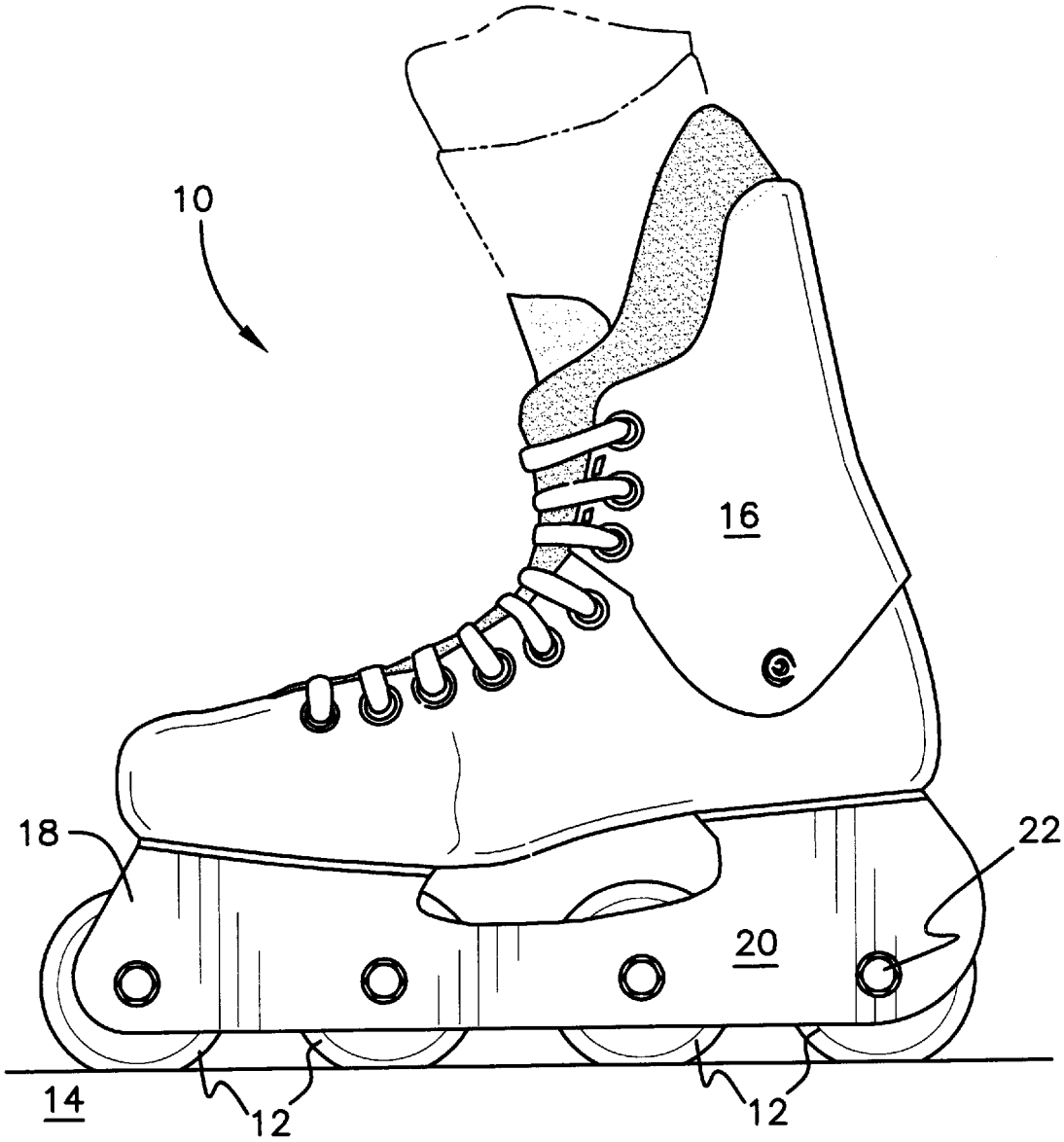
FIG. 1 is an environmental, side elevational view of a skate according to the present invention.

The present invention is to an improved skating device 10 having a plurality of tapered metallic wheels 12 which can be operated on an ice surface 14.

The invention consists of a boot 16 for securely receive the foot and ankle of a user (not shown). Attached to a lower periphery of the boot is a wheel support comprising a pair of vertical columns 18 and a central flange 20 which may have a U-shaped cross-section for receiving a plurality of wheels 12 therein.

Figure 2:
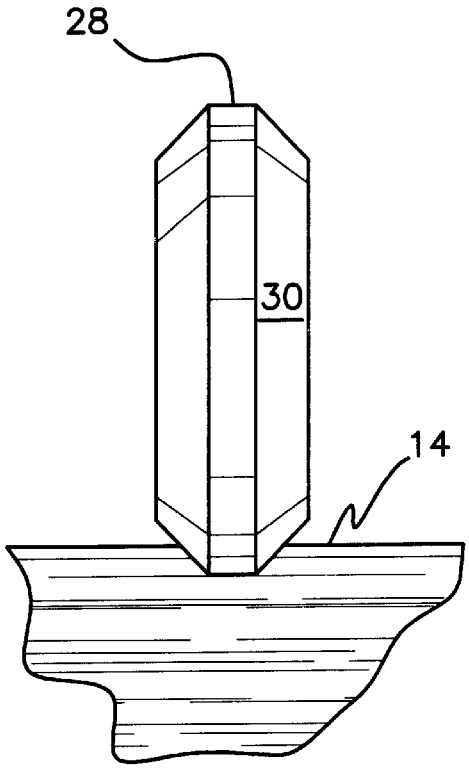
FIG. 2 is a front plan view of an ice skating wheel according to the present invention.
Figure 3:
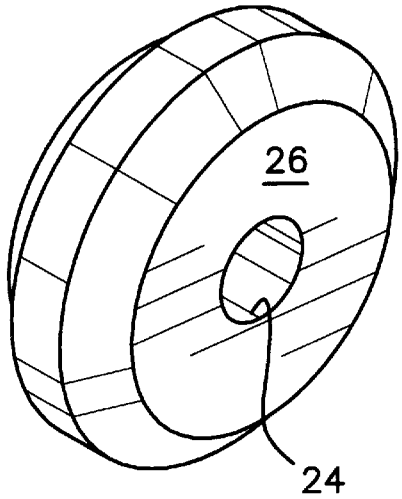
FIG. 3 is a perspective view of the ice skating wheel according to the present invention.

As best seen in FIGS. 2 and 3, each wheel has a central throughhole at 24. A body portion 26 having a substantially constant width. The wheel has an outer edged 28 for contacting the ice or other surface. Intermediate the constant width central body portion 26 and the outer edge 28 is a tapered section 30 which gradually thins from the constant width central body 26 to the outer edge 28. Preferably the tapered section 30 tapers to an outer edge having a width of 3/32 to 5/32 inch and preferably 3/16 inch, though one skilled in the art would recognize that other widths could be used depending on the stability of the skate desired and the coefficient of friction and the amount of ice melted by the skate.

A plurality of holes perpendicular to the longitudinal axis of flange 20 are formed through each side of the flange and aligned to receive a bolt 22 horizontally therethrough. The bolt, in a known manner, has a head larger than the hole and a smaller diameter body which is threaded along a portion of the bolt. The body of the bolt is passed through a hole on one side of the flange 20 through the central throughhole 24 of the wheel and through a hole in the opposite side of the flange. A nut or other suitable fastener (not shown) is threaded to the bolt or otherwise attached in a known manner to secure the wheel to the flange. Suitable washers or spacer in a known manner may also be distributed about the bolt between adjacent components to space the components from each other or reduce friction between parts.

Figure 4:
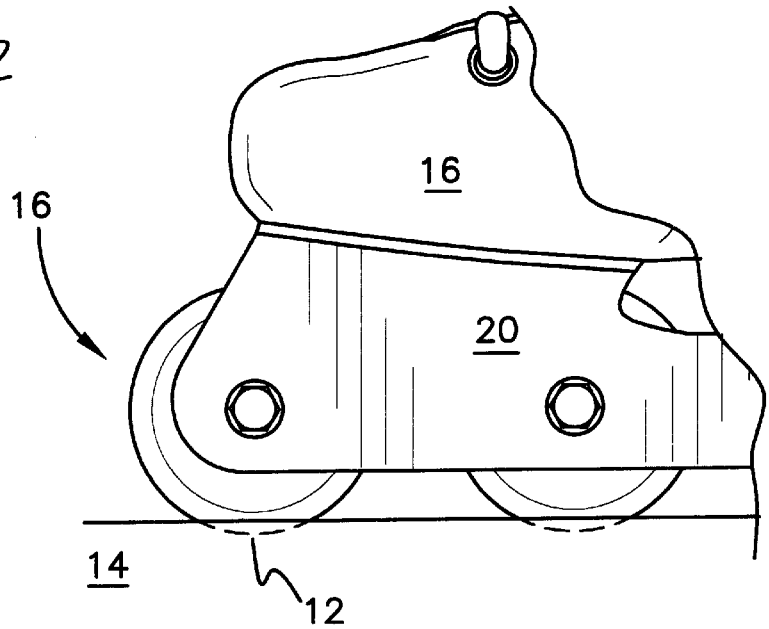
FIG. 4 is a side elevational view of the ice skating wheel according to the present invention operated on an ice surface.

In operation, as best shown in FIGS. 1 and 4, the user dons a pair of mirror image skates (left and right) by securing his feet (not shown) inside the boot compartment 16 of the skate(s) 10. With the plurality of wheels 12 secured beneath boot 16 through the wheel support flange 20, the skate may be operated on an ice surface. The metallic wheels 12 will have a portion 16 wheel which sinks into the ice due to the forces of gravity and the temporary melting of the ice 14 which occurs because of the friction generated by the skate against the ice and the pressure caused by the weight borne by the ice. The ability of the tapered metallic wheels to rotate will reduce the amount of friction of the skate against the ice by rolling through the ice and reduce the amount of rolling friction on the ice compared to a blade and therefor melting the ice less while still maintaining sufficient friction to provide steerage and "push off" to provide motive force.

A method of skating on ice is also contemplated by this invention comprising the steps of (a) providing an in-line skate, (b) mounting metallic wheels to a bottom portion of the in-line skate, (c) providing a taper to the metallic wheels from a central body portion of the wheels to an outer edge of the wheels, (d) reducing the width of the outer edge of the skate to a width of 3/32 to 5/32 inch and preferably to substantially 3/16 inch, (e) mounting the in-line skate to the foot of a user, (f) standing above the skates on an ice surface, (g) rolling the wheels along an ice surface to provide a motive force, and (h) allowing the wheels to glide along the ice surface.

It is to be understood that the present invention is not limited to the sole embodiment described above, but encompasses any and all embodiments within the scope of the following claims. It is also envisioned that the wheels could be sold separately as replacement wheels or substitute wheels for in-line skates to provide the user the ability to use the skates during the winter time on icy surfaces or on in-door ice skating rinks or wherever icy surfaces occur. In addition bearings may be added to the wheels to reduce the rolling resistance of the wheels and increase the life of contact parts.

I claim:

1. An in-line skate for skating on ice comprising:

a boot for securing the foot of a user, said boot having a lower periphery;

a wheel support connected to said lower periphery of said boot and having a central flange, said central flange having a plurality of holes defined therein spaced a predetermined distance apart;

a plurality of non-plastic wheels each having a central portion, a circumference and a central hole in said central portion defined therethrough and aligned with a one of said plurality of holes in said flange;

a plurality of bolts bolting said plurality of wheels to said flange and defining an axis of rotation; and at least one of said plurality of wheels comprises a constant width body section smoothly tapering radially outward from said body section to form a narrow outer edge parallel with said axis of rotation and centered about said wheel for contacting the ice.

2. An in-line skate according to claim 1, wherein at least one of said plurality of wheels is made of metal.

3. An in-line skate according to claim 2, wherein said outer edge has a width perpendicular to a radius of the wheel which is in the range of 3/32 to 5/32 inch.

* * * * *